US009435507B2

(12) United States Patent
Ikeda et al.

(10) Patent No.: US 9,435,507 B2
(45) Date of Patent: Sep. 6, 2016

(54) OPTICAL ELEMENT

(71) Applicant: NALUX CO., LTD., Osaka-shi, Osaka (JP)

(72) Inventors: Katsumoto Ikeda, Osaka (JP); Daisuke Seki, Osaka (JP); Kouei Hatade, Osaka (JP)

(73) Assignee: NALUX CO., LTD., Osaka-shi, Osaka (JP)

( * ) Notice: Subject to any disclaimer, the term of this patent is extended or adjusted under 35 U.S.C. 154(b) by 91 days.

(21) Appl. No.: 14/513,816

(22) Filed: Oct. 14, 2014

(65) Prior Publication Data

US 2015/0029727 A1 Jan. 29, 2015

Related U.S. Application Data

(63) Continuation of application No. PCT/JP2012/070336, filed on Aug. 9, 2012.

(60) Provisional application No. 61/641,980, filed on May 3, 2012.

(51) Int. Cl.
*F21V 5/04* (2006.01)
*F21V 5/00* (2015.01)
(Continued)

(52) U.S. Cl.
CPC ..... *F21V 5/002* (2013.01); *F21V 5/00* (2013.01); *F21Y 2101/02* (2013.01); *F21Y 2105/00* (2013.01)

(58) Field of Classification Search
CPC ..... F21V 5/00; F21V 5/04; F21V 5/046; F21V 5/002; F21Y 2102/02; H01L 33/58
See application file for complete search history.

(56) References Cited

U.S. PATENT DOCUMENTS 7,798,679 B2 * 9/2010 Kokubo ..... G02B 19/0061 362/334
8,405,920 B2 * 3/2013 Premysler ..... G02B 19/0028 359/359

(Continued)

FOREIGN PATENT DOCUMENTS

EP 1641052 A2 3/2006
EP 2023038 A2 2/2009

(Continued)

OTHER PUBLICATIONS

International Search Report and Written Opinion dated Nov. 13, 2012 corresponding to International Patent Application No. PCT/JP2012/070336 and English translation thereof.

*Primary Examiner* — Peggy Neils
(74) *Attorney, Agent, or Firm* — Squire Patton Boggs (US) LLP

(57) ABSTRACT

An optical element has a light receiving surface covering a light source arranged on a plane and an exit surface covering the light receiving surface. When an axis passing through the center of the light source and is perpendicular to the plane is designated as an optical axis and the point of intersection of the optical axis and the light receiving surface is designated as O1, the light receiving surface is concaved around the optical axis with respect to the periphery. When an angle which a normal to the light receiving surface on a point P thereon forms with the optical axis is designated as ϕh and distance in the optical axis direction from O1 to P is designated as z, ϕh has at least one local maximum value and at least one local minimum value with respect to z while P is moved along the light receiving surface.

15 Claims, 18 Drawing Sheets

(51) Int. Cl.
*F21Y 101/02* (2006.01)
*F21Y 105/00* (2016.01)

(56) References Cited

U.S. PATENT DOCUMENTS

2006/0066218 A1 3/2006 Yamaguchi et al.
2009/0052192 A1 2/2009 Kokubo et al.
2010/0226127 A1 9/2010 Bigliatti et al.

FOREIGN PATENT DOCUMENTS

EP 2461381 A2 6/2012
JP 3875247 B2 1/2007
JP 2009-44016 A 2/2009
JP 2010-152282 A 7/2010
WO WO 2010/091097 A1 8/2010

* cited by examiner

OPTICAL ELEMENT

BACKGROUND

1. Field

The present invention relates to an optical element configured to diffuse lights from the light source.

2. Description of Related Art

Recently LED (light emitting diode) light sources have been widely used. Since a large portion of lights of a LED light source is emitted toward the front, an optical element configured to diffuse lights from the LED light source is commonly used in combination with the LED light source. Particularly, when LED light sources are used as light sources of an illumination unit for illuminating a large area, such as that for backlight, optical elements configured to diffuse lights from the LED light sources over a large angle are used such that a compact illumination unit can be realized with a small number of LED light sources (for example, Patent Document 1).

An LED light source for a large amount of light consists of a light emitting chip for emitting shorter-wavelength lights such as blue light and a fluorescent material which emits longer-wavelength fluorescences such as green, yellow or red. In many cases, in such an LED light source, the light emitting chip for emitting shorter-wavelength lights is arranged at the center while the fluorescent material which emits longer-wavelength fluorescences is arranged around the light emitting chip. In such an LED light source, the position of the portion emitting shorter-wavelength lights and the position of the portion emitting longer-wavelength lights are dissimilar from each other. Accordingly, when the optical device is used to diffuse lights from the light source, in some cases there exist directions in which shorter-wavelength lights are stronger and directions in which longer-wavelength lights are stronger. As a result, in some cases the color of light may become bluish in some directions while may become reddish in other directions. That is, the color of light may vary depending on the direction. For the use in illumination units, it is not preferable that color of light varies depending on the direction. However, an optical element configured to diffuse lights from the light source, which can reduce color difference of lights which occurs due to direction, has not been developed so far.

Patent Document 1: JP2006-92983A (JP3875247B)

Accordingly, there is a need for an optical element configured to diffuse lights from the light source, which can reduce color difference of lights which occurs due to direction.

SUMMARY

An optical element according to a first aspect of the present invention is an optical element including a light receiving surface which is configured to cover a light source arranged on a plane and an exit surface which covers the light receiving surface, the optical element being configured such that lights from the light source passes through the light receiving surface and the exit surface and goes to the outside for illumination. When an axis which passes through the center of the light source and which is perpendicular to the plane is designated as an optical axis and the point of intersection of the optical axis and the light receiving surface is designated as O1, the light receiving surface is concaved around the optical axis with respect to the periphery. In a cross section of the optical element, the cross section containing the optical axis and being perpendicular to the plane, when an angle which a normal to the light receiving surface on a point P on the light receiving surface forms with the optical axis is designated as $\phi h$ and distance in the optical axis direction from the point O1 to the point P is designated as z, the light receiving surface is configured such that $\phi h$ has at least one local maximum value and at least one local minimum value with respect to z while the point P is moved along the light receiving surface from the point O1 to the plane.

In the optical element according to the present aspect, the light receiving surface is configured such that $\phi h$ has at least one local maximum value and at least one local minimum value with respect to z, and therefore when used in combination with a light source, rays from each point on the light source are refracted in various directions depending on location on the light receiving surface which each ray reaches. Accordingly, color difference of lights which occurs due to direction in which light is emitted from the optical element can be reduced.

An optical element according to an embodiment of the present invention is an optical element of the first aspect in which the light receiving surface is shaped rotationally symmetric around the optical axis.

The optical element according to the present embodiment can be manufactured without great difficulty by injection molding or the like.

An optical element according to another embodiment of the present invention is an optical element of the first aspect in which a space around the optical axis is partitioned based on angle around the optical axis into plural zones and the light receiving surface is configured to have different shapes in respective zones.

According to the present embodiment, different light distributions can be realized for respective directions corresponding to zones around the optical axis.

An optical element according to another embodiment of the present invention is an optical element of the first aspect in which in some of the zones alone, the light receiving surface is configured such that $\phi h$ has at least one local maximum value and at least one local minimum value with respect to z while the point P is moved along the light receiving surface the from the point O1 to the plane.

According to the present embodiment, in some of the zones around the optical axis alone, color difference of lights which occurs due to the direction can be reduced.

In an optical element according to another embodiment of the present invention, when the point of intersection of the optical axis and the plane is designated as a point P0 and an angle which a line connecting the point P0 and the point P on the light receiving surface forms with the optical axis is designated as $\theta r$, the light receiving surface is configured such that $\phi h$ has at least one local maximum value and at least one local minimum value with respect to z in the range $30° < \theta r < 90°$.

In the optical element according to the present embodiment, in the range $30° < \theta r < 90°$, in which inclination of $\phi h$ data graphed with respect to z would be substantially constant if there were no local maximum value or no local minimum value, the light receiving surface is configured such that $\phi h$ has at least one local maximum value and at least one local minimum value with respect to z. As a result, when used in combination with a light source, rays from each point on the light source are refracted in more various directions depending on location on the light receiving surface which each ray reaches, compared with the case that there is no local maximum value or no local minimum value.

Accordingly, color difference of lights which occurs due to direction in which light is emitted from the optical element can be reduced.

An optical element according to another embodiment of the present invention is an optical element of the first aspect in which there exist a local maximum value and a local minimum value which are adjacent to each other and between which a difference in $\phi h$ is 10 degrees or more.

When the optical element of the present embodiment is used in combination with a light source, direction in which a ray from each point on the light source travels after having been refracted on the light receiving surface remarkably varies depending on location on the light receiving surface which the ray reaches. Accordingly, color difference of lights which occurs due to direction in which light is emitted from the optical element can be reduced.

An optical element according to another embodiment of the present invention is an optical element of the first aspect in which there exist a local maximum value and a local minimum value which are adjacent to each other and between which a difference in $\phi h$ is 20 degrees or more.

When the optical element of the present embodiment is used in combination with a light source, direction in which a ray from each point on the light source travels after having been refracted on the light receiving surface remarkably varies depending on location on the light receiving surface which the ray reaches. Accordingly, color difference of lights which occurs due to direction in which light is emitted from the optical element can be reduced.

An optical element according to a second aspect of the present invention is an optical element including a light receiving surface which is configured to cover a light source arranged on a plane and an exit surface which covers the light receiving surface, the optical element being configured such that lights from the light source passes through the light receiving surface and the exit surface and goes to the outside for illumination. When an axis which passes through the center of the light source and which is perpendicular to the plane is designated as an optical axis, the point of intersection of the optical axis and the light receiving surface is designated as O1, and the point of intersection of the optical axis and the plane is designated as P0, the light receiving surface is concaved around the optical axis with respect to the periphery. In a cross section of the optical element, the cross section containing the optical axis and being perpendicular to the plane, when an angle which a line connecting the point P0 and a point P on the light receiving surface forms with the optical axis is designated as $\theta r$, and a direction of light which travels inside the optical element after having traveled from the point P0 to the point P forms with the optical axis is designated as $\theta i$, the light receiving surface is configured such that $\theta i$ has at least one local maximum value and at least one local minimum value with respect to $\theta r$ while the point P is moved along the light receiving surface from the point O1 to the plane.

In the optical element according to the present aspect, the light receiving surface is configured such that $\theta i$ has at least one local maximum value and at least one local minimum value with respect to $\theta r$, and therefore when used in combination with a light source, rays from each point on the light source are refracted in various directions depending on location on the light receiving surface which each ray reaches. Accordingly, color difference of lights which occurs due to direction in which light is emitted from the optical element can be reduced.

An optical element according to another embodiment of the present invention is an optical element of the second aspect in which the light receiving surface is shaped rotationally symmetric around the optical axis.

The optical element according to the present embodiment can be manufactured without great difficulty by injection molding or the like.

An optical element according to another embodiment of the present invention is an optical element of the second aspect in which a space around the optical axis is partitioned based on angle around the optical axis into plural zones and the light receiving surface is configured to have different shapes in respective zones.

According to the present embodiment, different light distributions can be realized for respective directions corresponding to zones around the optical axis.

An optical element according to another embodiment of the present invention is an optical element of the second aspect in which in some of the zones alone, the light receiving surface is configured such that $\theta i$ has at least one local maximum value and at least one local minimum value with respect to $\theta r$ while the point P is moved along the light receiving surface the from the point O1 to the plane.

According to the present embodiment, in some of the zones around the optical axis alone, color difference of lights which occurs due to the direction can be reduced.

An optical element according to another embodiment of the present invention is an optical element of the second aspect in which the light receiving surface is configured such that $\theta i$ has at least one local maximum value and at least one local minimum value with respect to $\theta r$ in the range $30° < \theta r < 90°$.

In the optical element according to the present embodiment, in the range $30° < \theta r < 90°$, in which inclination of $\theta i$ data graphed with respect to $\theta r$ were substantially constant if there had been no local maximum value or no local minimum value, the light receiving surface is configured such that $\theta i$ has at least one local maximum value and at least one local minimum value with respect to $\theta r$. As a result, when used in combination with a light source, rays from each point on the light source are refracted in more various directions depending on location on the light receiving surface which each ray reaches, compared with the case that there is no local maximum value or no local minimum value. Accordingly, color difference of lights which occurs due to direction in which light is emitted from the optical element can be reduced.

An optical element according to another embodiment of the present invention is an optical element of the second aspect in which there exist a local maximum value and a local minimum value which are adjacent to each other and between which a difference in $\theta i$ is 5 degrees or more.

When the optical element of the present embodiment is used in combination with a light source, direction in which a ray from each point on the light source travels after having been refracted on the light receiving surface remarkably varies depending on location on the light receiving surface which the ray reaches. Accordingly, color difference of lights which occurs due to direction in which light is emitted from the optical element can be reduced.

An optical element according to another embodiment of the present invention is an optical element of the second aspect in which there exist a local maximum value and a local minimum value which are adjacent to each other and between which a difference in $\theta i$ is 10 degrees or more.

When the optical element of the present embodiment is used in combination with a light source, direction in which a ray from each point on the light source travels after having been refracted on the light receiving surface remarkably varies depending on location on the light receiving surface which the ray reaches. Accordingly, color difference of lights which occurs due to direction in which light is emitted from the optical element can be reduced.

An illumination unit according to a third aspect of the present invention is an illumination unit including a light source and the optical element according to the first aspect or the second aspect of the present invention.

The illumination unit according to the present aspect uses the optical element according to any one of the aspects of the present invention, and therefore color difference of lights which occurs due to direction in which light is emitted from the optical element can be reduced.

DETAILED DESCRIPTION

Figure 1A:
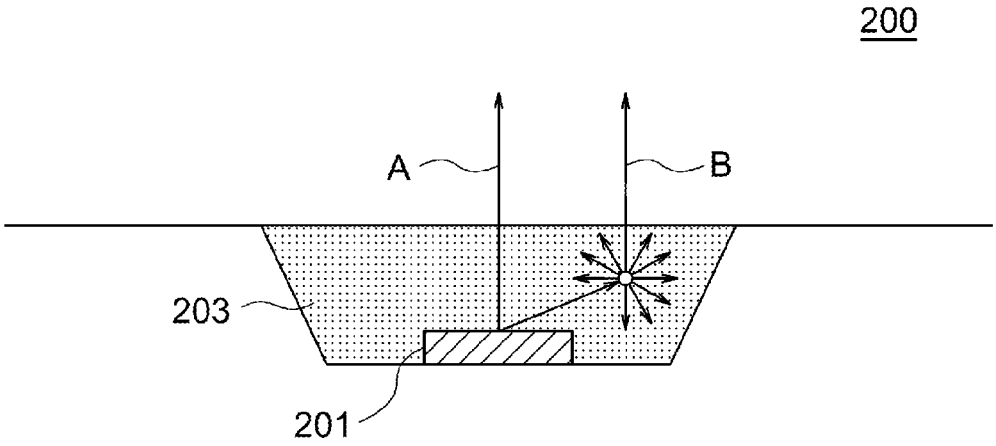
FIGS. 1A and 1B show an example of a LED light source used with an optical element according to the present invention.
Figure 1B:
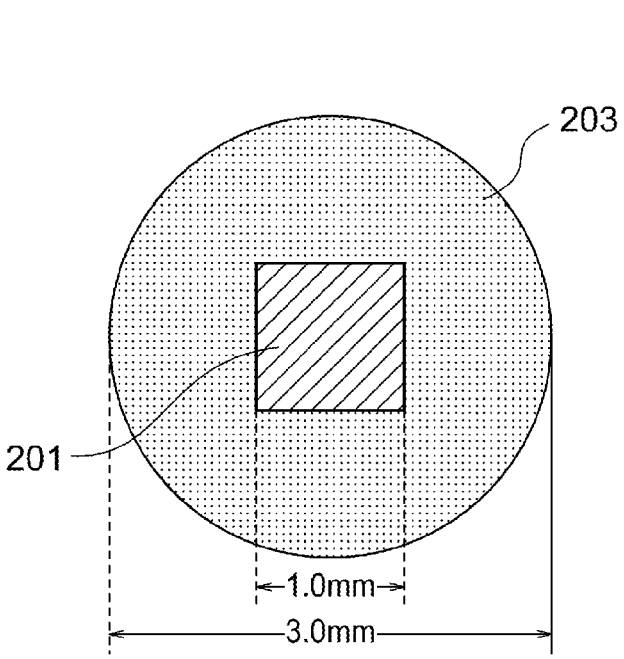

FIGS. 1A and 1B show an example of a LED light source 200 used with an optical element according to the present invention. FIG. 1A shows a cross section perpendicular to the light-emitting surface of the LED light source 200. FIG. 1B shows a plan view of the LED light source 200. In general, an LED light source for a large amount of light consists of a light emitting chip for emitting shorter-wavelength lights such as blue light and a fluorescent agent which emits longer-wavelength fluorescences such as green, yellow or red. In FIGS. 1A and 1B, a light emitting chip 201 of blue light is arranged at the center of the LED light source 200 while a fluorescent agent 203 is arranged in an area which is larger than the area occupied by the light emitting chip such that the fluorescent agent 203 covers the light emitting chip 201. In the plan view of FIG. 1B, the light emitting chip 201 is a square with sides of 1.0 millimeter while the fluorescent agent 203 is shaped as a circle with a diameter of 3.0 millimeters. A blue ray A is emitted by the light emitting chip 201 located around the center. A ray B of longer wavelength is emitted by the fluorescent agent arranged in an area which includes the periphery of the LED light source. In a LED light source having such a structure as shown in FIGS. 1A and 1B, the location where blue rays are emitted and the location where rays of longer wavelengths are emitted are dissimilar from each other.

Figure 2:
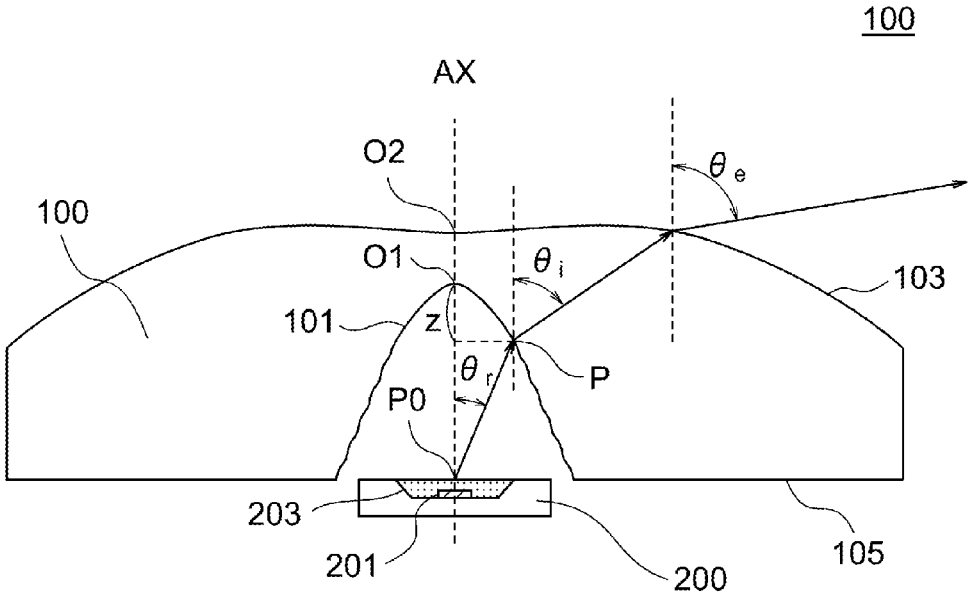
FIG. 2 shows a cross section of an optical element used to diffuse lights from the light source according to an embodiment of the present invention, the cross section containing the central axis AX of the optical element.

FIG. 2 shows a cross section of an optical element 100 used to diffuse lights from the light source 200 according to an embodiment of the present invention. The cross section contains the central axis AX of the optical element 100. The optical element 100 according to the present embodiment is of a shape having rotational symmetry around the central axis AX. A face 105 which faces the light source 200 has an area recessed relative to the periphery, around the central axis AX. The surface of the recessed area forms a light receiving surface 101. The face 105 which faces the light source 200 is referred to as a bottom face 105 in the present specification. The surface of the optical element 100 besides the light receiving surface 101 and the bottom face 105 forms an exit surface 103.

The optical element 100 and the light source 200 are arranged such that the central axis AX of the optical element 100 passes through the center of the light source 200, that is, the center of the circle shown in FIG. 1B. In this case, the central axis AX forms the optical axis of the optical system including the optical element 100 and the LED light source 200.

Lights emitted by the light source 200 enter the optical element 100 through the light receiving surface 101 and are emitted to the outside through the exit surface 103. In this case, lights emitted by the light source 200 are refracted at most portions of the light receiving surface 101 and the exit surface 103 such that the lights travel away from the central axis AX. As a result, the lights are diffused.

In the present embodiment, the surface of the LED light source 200 is planar. However, the surface of the light source 200 does not necessarily have to be planar. The present invention can be applied to any light sources arranged on a plane, in which the position of the portion emitting shorter-wavelength lights and the position of the portion emitting lights differ from each other.

Figure 3:
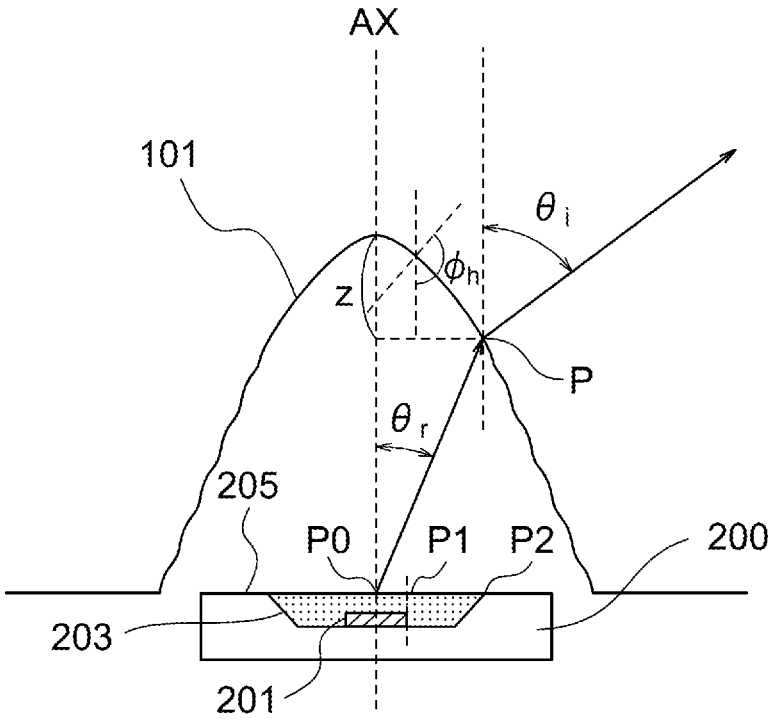
FIG. 3 shows an enlarged view of the portion of the light receiving surface in the cross section of FIG. 2.

FIG. 3 shows an enlarged view of the portion of the light receiving surface in the cross section of FIG. 2. The point of intersection of the light emitting surface 205 of the light source 200 and the central axis AX is designated as a point P0. The angle which a travelling direction of a ray emitted from the point P0 forms with the central axis AX is designated as θr, and the angle which a travelling direction of the ray which travels in the optical element 100 after having been refracted at the light receiving surface 101 forms with the central axis AX is designated as θi. The angle which a travelling direction of the ray which travels after having been refracted at the exit surface forms with the central axis AX is designated as θe (See FIG. 2). In FIG. 3, a foot of a perpendicular line from a point representing a side of the emitting chip 201 to a line representing the emitting surface 205 is designated as P1, and a point at an edge of the fluorescent agent, that is, a point on the circumstance of the circle which forms the periphery of the fluorescent agent is designated as P2.

The light receiving surface 101 is determined such that θr<θi is satisfied for rays emitted at θr in a certain range. In FIG. 3, the certain range is from 0 degree to approximately 20 degrees. In the above-described range, angle θi monotonously increases as angle θr increases.

The exit surface 103 is determined such that θr<θe is satisfied for rays emitted at θr which is in the above-described certain range.

A shape of the exit surface around the central axis AX is not limited to convex, nor to concave. The shape may be convex, concave or planar. A shape of the exit surface which does not generate total reflection inside the lens is also preferable. In this case, when refractive index of the optical element is designated as n, an angle ϕ between a ray travelling in the optical element and the normal to the exit surface satisfies the following relationship.

$$\phi<\sin^{-1}(1/n)$$

Further, in FIG. 3, an angle which a normal to the light receiving surface 101 forms with the central axis AX is designated as ϕh. The angle is measured with reference to the downward direction in FIG. 3. That is, the following equation holds at the top of the light receiving surface 101.

$$\phi h=180 \text{ degrees}$$

In the area of the light receiving surface 101 which lights emitted from the point P0 at an angle θr in the range from 0 degree to approximately 20 degrees reach, angle ϕh monotonously decreases as angle θr increases. In the area of the light receiving surface 101 which lights emitted from the point P0 at an angle θr which is greater than approximately 20 degrees reach, angle ϕh repeatedly fluctuates as angle θr increases. This area of the light receiving surface 101 is referred to as a diffusing area of the light receiving surface in the present specification. A shape of the diffusing area of the light receiving surface 101 will be described in detail later.

Figure 4:
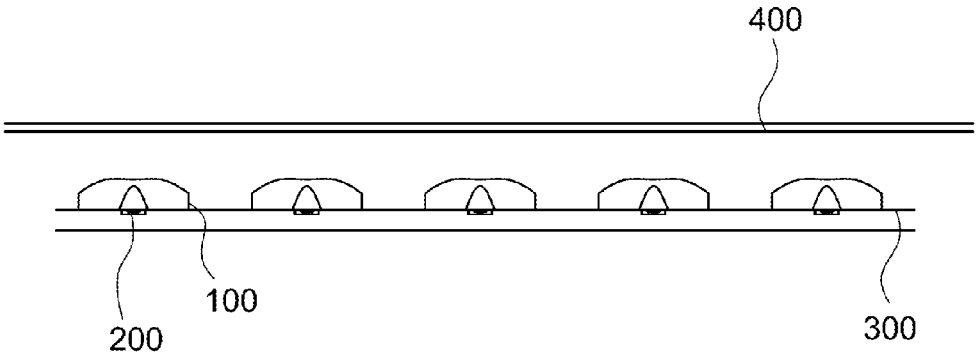
FIG. 4 shows an example of the configuration of an illumination unit in which plural sets of the light source and the optical element are arranged on a plane.

FIG. 4 shows an example of the configuration of an illumination unit in which plural sets of the light source 200 and the optical element 100 are arranged on a plane 300. The illumination unit is further provided with a diffuser 400. The illumination unit permits uniform illumination on an area ahead of the illumination unit (above the illumination unit in FIG. 4).

Examples of the optical elements according to the present invention and their comparative examples will be described below. The material of the optical elements of the examples and the comparative examples is polymethyl methacrylate (PMMA), refractive index of which is 1.492 (d line, 587.56 nm) and Abbe's number of which is 56.77 (d line, 587.56 nm). Further, in the examples and the comparative examples, unit of length is millimeter unless otherwise designated.

Example 1

In FIG. 2, the coordinates of the point of intersection of the light receiving surface 101 and the central axis AX are represented as O1 while the coordinates of the point of intersection of the exit surface 103 and the central axis AX are represented as O2.

In the present example, the distance T between P0 and O2 is given as below.

T=5.752 mm

The distance h between P0 and O1 is given as below.

h=4.400 mm

When distance from O1 in the direction of the central axis AX is represented as z, a shape of the light receiving surface 101 can be represented by the following equation in the range where z is between 0 and 1.5 mm inclusive (0≤z≤1.5 mm).

$$z = \frac{cr^2}{1+\sqrt{1-(1+k)c^2r^2}} + \sum_{i=1}^{N} A_i r^i \quad (1)$$

$$c = 1/R$$

In the equation, r represents distance from the central axis AX, c represents curvature, R represents radius of curvature, k represents conic constant and Ai represents aspheric coefficient.

Table 1 shows numerical values of constants in Equation (1) which represents the light receiving surface 101 of Example 1.

TABLE 1

| | |
|---|---|
| R | −1.201 |
| K | −0.7990 |
| A1 | 0.000 |

TABLE 1-continued

| | |
|---|---|
| A2 | 0.000 |
| A3 | 0.000 |
| A4 | 0.000 |

A shape of the area of the light receiving surface 101 which extends from z=1.5 mm to the face 105, that is, a shape of the diffusing area is represented as a third-order spline curve, a point group of which is given below. A third-order spline curve is a smooth curve which passes through given points, in which each segment between adjacent points is connected by an individual third-order polynomial and the individual polynomials are made continuous at all the points.

Table 2 shows the above-described point group.

TABLE 2

| z | r |
|---|---|
| 1.500 | 1.70 |
| 1.661 | 1.80 |
| 1.822 | 1.82 |
| 1.983 | 1.85 |
| 2.144 | 1.95 |
| 2.306 | 1.97 |
| 2.467 | 2.00 |
| 2.628 | 2.10 |
| 2.789 | 2.12 |
| 2.950 | 2.15 |
| 3.111 | 2.25 |
| 3.272 | 2.27 |
| 3.433 | 2.30 |
| 3.594 | 2.40 |
| 3.756 | 2.42 |
| 3.917 | 2.45 |
| 4.078 | 2.55 |
| 4.239 | 2.57 |
| 4.400 | 2.60 |

Figure 5:
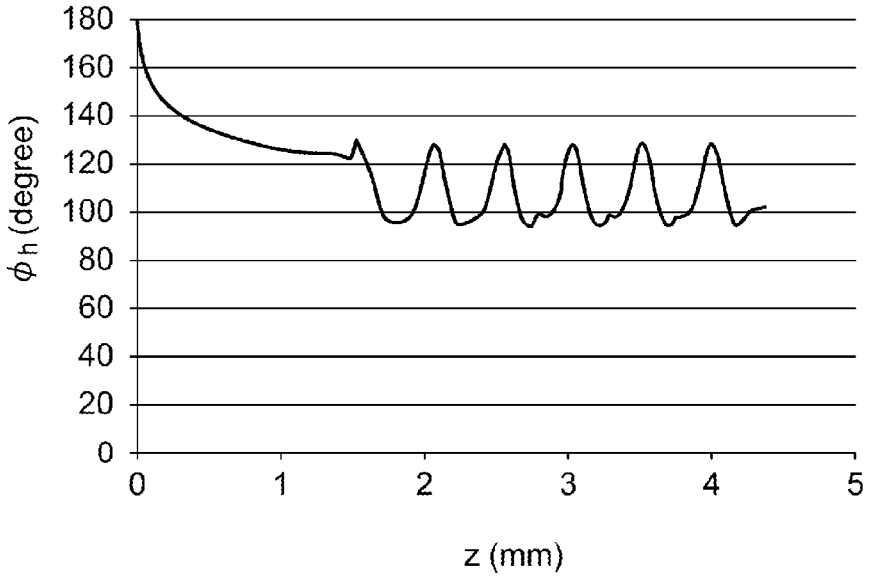
FIG. 5 shows a relationship between z and angle ϕh which a normal to the light receiving surface forms with the central axis AX in the optical element of Example 1.

FIG. 5 shows a relationship between z of the light receiving surface 101 and angle ϕh which a normal to the light receiving surface 101 forms with the central axis AX in the optical element of Example 1. The horizontal axis of FIG. 5 represents z while the vertical axis represents ϕh. According to FIG. 5, in the range where z is 1.5 mm or less, ϕh monotonously decreases as z increases. In the range where z is greater than 1.5 mm, ϕh repeatedly fluctuates as z increases. In other words, in the range where z is greater than 1.5 mm, ϕh which is a function of z has local maximum values and local minimum values.

Specifically, in FIG. 5, ϕh has 6 local maximum values and 6 local minimum values. Minor fluctuations of ϕh around the local minimum values have been ignored. Difference in ϕh between a local maximum value and a local minimum value which are adjacent to each other is approximately 30 degrees.

When distance from O2 in the direction of the central axis AX is represented as z, a shape of the exit surface 103 around the central axis AX is what does not cause total reflection of rays from the light source on the exit surface and can be represented by the following equation.

$$z = \frac{cr^2}{1+\sqrt{1-(1+k)c^2r^2}} + \sum_{i=1}^{N} A_i r^i \quad (2)$$

$$c = 1/R$$

In the equation, r represents distance from the central axis AX, c represents curvature, R represents radius of curvature, k represents conic constant and Ai represents aspheric coefficient.

Table 3 shows numerical values of constants in Equation (2) which represents the exit surface of Example 1.

TABLE 3

| | |
|---|---|
| R | −2.222 |
| K | −7.513 |
| A1 | 0.000 |
| A2 | −3.75E−02 |
| A3 | −4.78E−04 |
| A4 | −2.51E−04 |
| A5 | 0.000 |
| A6 | 0.000 |
| A7 | 0.000 |
| A8 | 0.000 |
| A9 | 0.000 |
| A10 | 0.000 |

Figure 6:
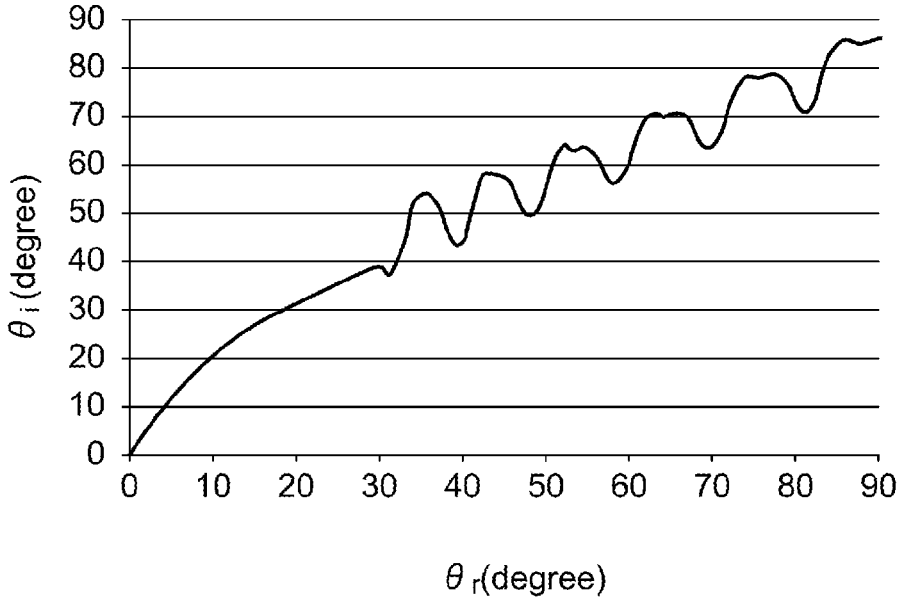
FIG. 6 shows a relationship between θr and θi in the optical element of Example 1.

FIG. 6 shows a relationship between θr and θi on the light receiving surface in the optical element of Example 1. The horizontal axis of FIG. 6 represents θr while the vertical axis represents θi. In the range where θr is approximately 30 degrees or less, θi monotonously increases as θr increases. In the range where θr is greater than approximately 30 degrees, θi increases while repeatedly fluctuating as θr increases. In other words, θi which is a function of θr has local maximum values and local minimum values.

Specifically, in FIG. 6, θi has 6 local maximum values and 6 local minimum values in the range where θr is from approximately 30 degrees to 90 degrees. Minor fluctuations of around the local maximum values of θi have been ignored. Difference in θi between a local maximum value and a local minimum value which are adjacent to each other is approximately 15 degrees.

Figure 7:
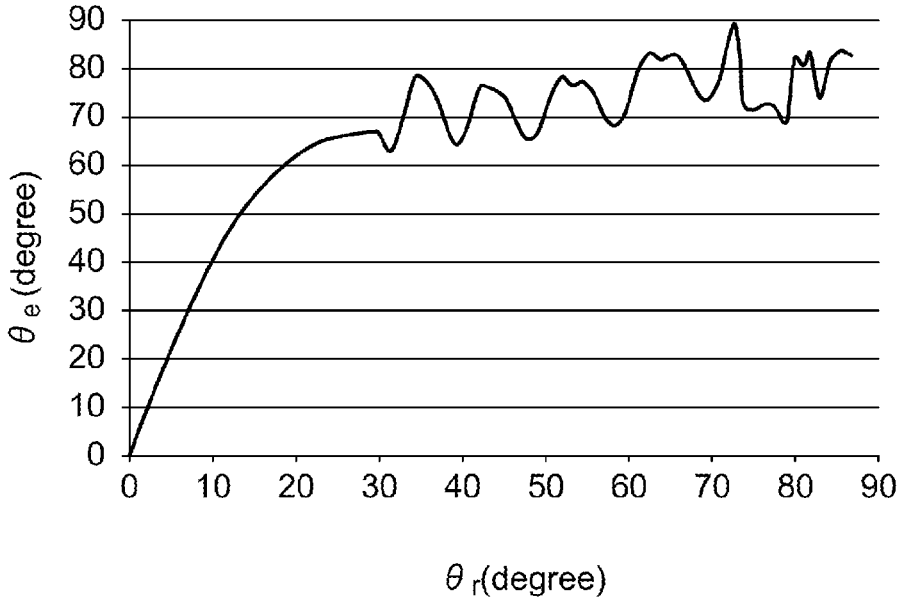
FIG. 7 shows a relationship between θr and θe in the optical element of Example 1.

FIG. 7 shows a relationship between θr and θe on the exit surface of the optical element of Example 1. The horizontal axis of FIG. 7 represents θr while the vertical axis represents θe. In the range where θr is approximately 30 degrees or less, θe monotonously increases as θr increases. In the range where θr is greater than approximately 30 degrees, θe increases while repeatedly fluctuating with a peak-to-peak amplitude of approximately 10 degrees as θr increases. In other words, θe which is a function of θr has local maximum values and local minimum values in the range where θr is greater than approximately 30 degrees.

Comparative Example 1

In the present comparative example, the distance T between P0 and O2 is given as below.

T=5.752 mm

The distance h between P0 and O1 is given as below.

h=4.400 mm

When distance from O1 in the direction of the central axis AX is represented as z, a shape of the light receiving surface can be represented by Equation (1). Further, values of constants in Equation (1) are those shown in Table 1. That is, a shape of the light receiving surface of Comparative Example 1 is identical with that of Example 1 in the range where z is 1.5 mm or less, and in the range where z is greater than 1.5 mm, ϕh which is a function of z does not have a local maximum value or a local minimum value and monotonously decreases as z increases. In other words, the light receiving surface of the optical element of Comparative Example 1 differs from the light receiving surface of Example 1 in that it does not have a diffusing area of the light receiving surface.

When distance from O2 in the direction of the central axis AX is represented as z, a shape of the exit surface around the central axis AX is what does not cause total reflection of rays from the light source on the exit surface and can be represented by Equation (2). Further, values of constants in Equation (2) are those shown in Table 3. That is, a shape of the exit surface of Comparative Example 1 is identical with that of Example 1.

Performance Comparison Between Example 1 and Comparative Example 1

Performance comparison between Example 1 and Comparative Example 1 will be made by comparing light intensity distribution between the case of a combination of the light source shown in FIGS. 1A and 1B and the optical element of Example 1 and the case of a combination of the light source shown in FIGS. 1A and 1B and the optical element of Comparative Example 1.

Figure 8:
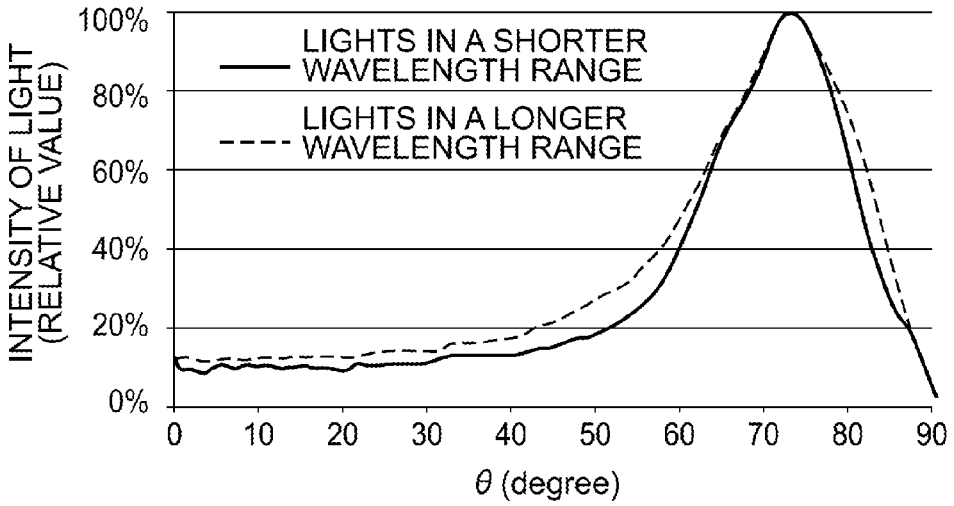
FIG. 8 shows a light intensity distribution for the case of a combination of the light source shown in FIGS. 1A and 1B and the optical element of Example 1.

FIG. 8 shows a light intensity distribution for the case of a combination of the light source shown in FIGS. 1A and 1B and the optical element of Example 1. The horizontal axis of FIG. 8 represents direction which forms angle θ with the central axis AX. The vertical axis of FIG. 8 represents relative value of intensity of light which is emitted in the direction which forms angle θ with the central axis AX. The solid line in FIG. 8 represents relative value of intensity of lights which have wavelengths of less than 500 nanometers (lights in a shorter wavelength range). The relative value of intensity is scaled such that the maximum value is 100%. The dashed line in FIG. 8 represents relative value of intensity of lights which have wavelengths of 500 nanometers or more (lights in a longer wavelength range). The relative value of intensity is scaled such that the maximum value is 100%.

Figure 9:
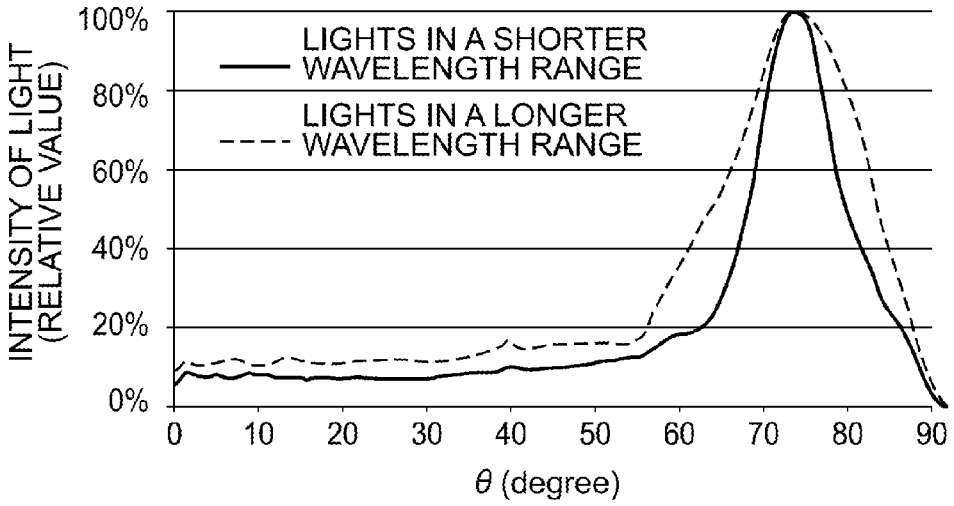
FIG. 9 shows a light intensity distribution for the case of a combination of the light source shown in FIGS. 1A and 1B and the optical element of Comparative Example 1.

FIG. 9 shows a light intensity distribution for the case of a combination of the light source shown in FIGS. 1A and 1B and the optical element of Comparative Example 1. The horizontal axis of FIG. 9 represents direction which forms angle θ with the central axis AX. The vertical axis of FIG. 9 represents relative value of intensity of light which is emitted in the direction which forms angle θ with the central axis AX. The solid line in FIG. 9 represents relative value of intensity of lights which have wavelengths of less than 500 nanometers (lights in a shorter wavelength range). The relative value of intensity is scaled such that the maximum value is 100%. The dashed line in FIG. 9 represents relative value of intensity of lights which have wavelengths of 500 nanometers or more (lights in a longer wavelength range). The relative value of intensity is r scaled such that the maximum value is 100%.

When FIG. 8 and FIG. 9 are compared with each other, difference in intensity of light between the shorter wavelength range and the longer wavelength range is greater in FIG. 9 which relates to Comparative Example 1. The difference between the both is particularly great when 0 is around 60 degrees. When the difference between the both is great, a difference in color is generated. For example, in the case that intensity of the longer wavelength range becomes greater in an area where θ is around 60 degrees as shown in FIG. 9, light becomes reddish in the area where θ is around 60 degrees.

Thus, the optical element of Example 1 is superior to that of Comparative Example 1 in preventing a difference in color from being generated.

Figure 10:
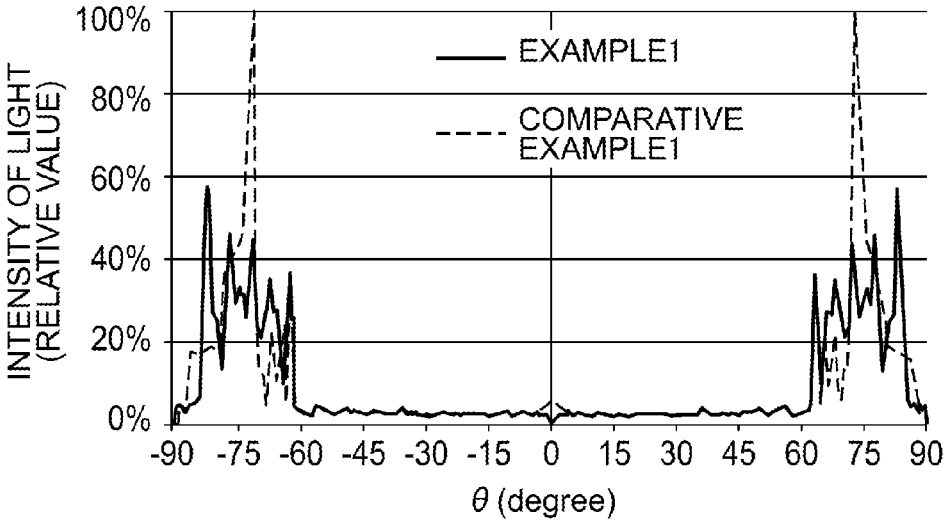
FIG. 10 shows an intensity distribution of rays emitted from a point P0 which is shown in FIG. 3 in the optical element of Example 1.

FIG. 10 shows an intensity distribution of rays emitted from a point P0 which is shown in FIG. 3 in the optical element of Example 1. The point P0 is the point of intersection of the emitting surface 205 of the light source 200 and the central axis AX. The horizontal axis of FIG. 10 represents direction which forms angle θ with the central axis AX. The vertical axis of FIG. 10 represents relative value of intensity of light which is emitted in the direction which forms angle θ with the central axis AX. The solid line represents an intensity distribution of Example 1 while the dashed line represents an intensity distribution of Comparative Example 1. The relative value of intensity for Example 1 and that for Comparative Example 1 are scaled such that the maximum value is 100%.

Figure 11:
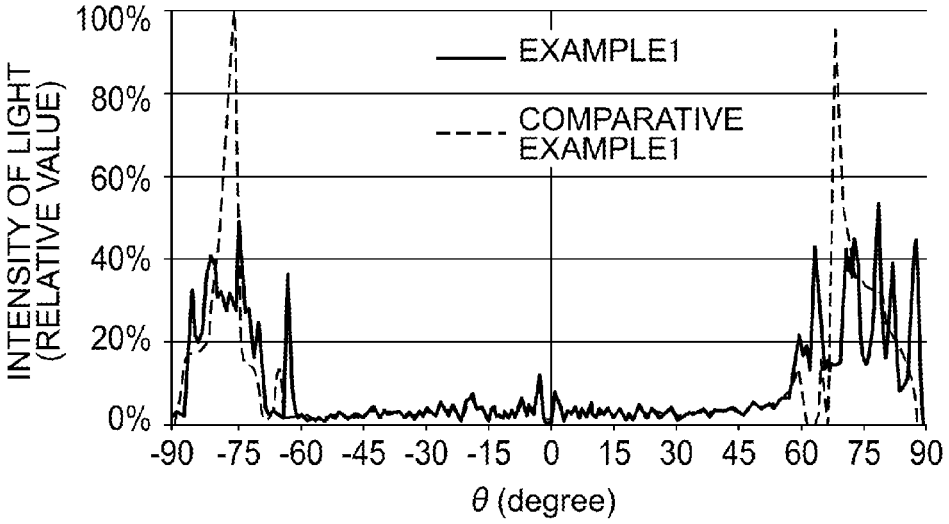
FIG. 11 shows an intensity distribution of rays emitted from a point P1 which is shown in FIG. 3 in the optical element of Example 1.

FIG. 11 shows an intensity distribution of rays emitted from a point P1 which is shown in FIG. 3 in the optical element of Example 1. The point P1 is a foot of a perpendicular line from a point representing a side of the emitting chip 201 to a line representing the emitting surface 205. The horizontal axis of FIG. 11 represents direction which forms angle θ with the central axis AX. The vertical axis of FIG. 11 represents relative value of intensity of light which is emitted in the direction which forms angle θ with the central axis AX. The solid line in FIG. 11 represents an intensity distribution of Example 1 while the dashed line represents an intensity distribution of Comparative Example 1. The relative value of intensity for Example 1 and that for Comparative Example 1 are scaled such that the maximum value is 100%.

Figure 12:
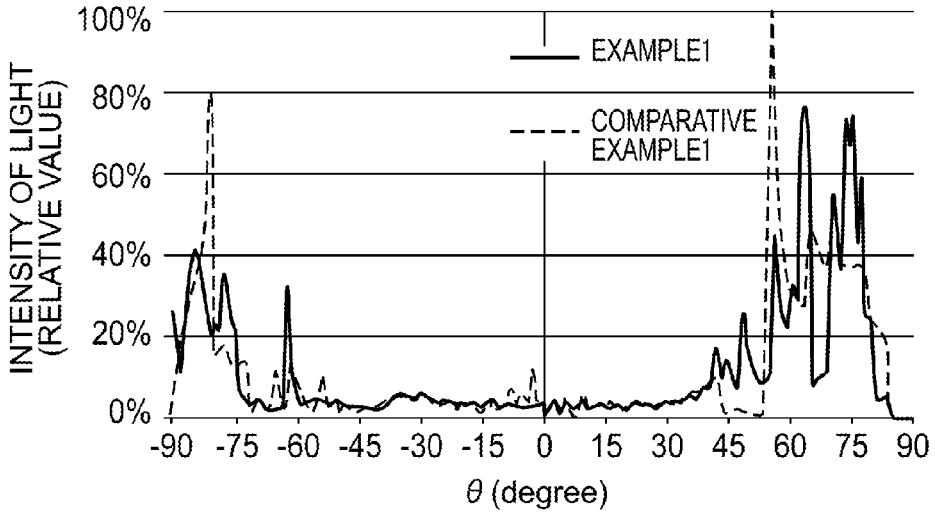
FIG. 12 shows an intensity distribution of rays emitted from a point P2 which is shown in FIG. 3 in the optical element of Example 1.

FIG. 12 shows an intensity distribution of rays emitted from a point P2 which is shown in FIG. 3 in the optical element of Example 1. The point P2 is a point on the circumstance forming the periphery of the fluorescent agent. The horizontal axis of FIG. 12 represents direction which forms angle θ with the central axis AX. The vertical axis of FIG. 12 represents relative value of intensity of light which is emitted in the direction which forms angle θ with the central axis AX. The solid line in FIG. 12 represents an intensity distribution of Example 1 while the dashed line represents an intensity distribution of Comparative Example 1. The relative value of intensity for Example 1 and that for Comparative Example 1 are scaled such that the maximum value is 100%.

According to a comparative inspection of rays emitted from P0, P1 and P2 in FIGS. 10 to 12, rays of Example 1 are distributed in a wider area than rays of Comparative Example 1. Lights shown in FIG. 8 and FIG. 9 are a combination of rays emitted from various points on the surface of the light source. Thus, in the case of Example 1 where rays emitted from each of the various points are distributed in a wider area, difference in position on the surface of the light source has a smaller influence on difference in color.

Example 2

In FIG. 2, the coordinates of the point of intersection of the light receiving surface 101 and the central axis AX are represented as O1 while the coordinates of the point of intersection of the exit surface 103 and the central axis AX are represented as O2.

In the present example, the distance T between P0 and O2 is given as below.

T=5.513 mm

The distance h between P0 and O1 is given as below.

h=3.569 mm

When distance from O1 in the direction of the central axis AX is represented as z, a shape of the light receiving surface 101 can be represented by the following equation in the range where z is between 0 and 2.689 mm inclusive (0≤z≤2.689 mm).

$$z = \frac{cr^2}{1+\sqrt{1-(1+k)c^2r^2}} + \sum_{i=1}^{N} A_i r^i \quad (1)$$

$$c = 1/R$$

In the equation, r represents distance from the central axis AX, c represents curvature, R represents radius of curvature, k represents conic constant and Ai represents aspheric coefficient.

Table 4 shows numerical values of constants in Equation (1) which represents the light receiving surface 101 of Example 2.

TABLE 4

| | |
|---|---|
| R | −0.9793 |
| k | −0.7528 |
| A1 | 0.000 |
| A2 | 0.000 |
| A3 | 0.000 |
| A4 | 0.000 |

A shape of the area of the light receiving surface 101 which extends from z=2.689 mm to the face 105, that is, a shape of the diffusing area is represented as a third-order spline curve, a point group of which is given below. A third-order spline curve is a smooth curve which passes through given points, in which each segment between adjacent points is connected by an individual third-order polynomial and the individual polynomials are made continuous at all the points.

Table 5 shows the above-described point group.

TABLE 5

| z | r |
|---|---|
| 2.689 | 1.82 |
| 2.789 | 1.90 |
| 2.889 | 1.90 |
| 2.989 | 1.90 |
| 3.089 | 1.95 |
| 3.189 | 1.95 |
| 3.289 | 1.95 |
| 3.389 | 2.00 |
| 3.489 | 2.00 |
| 3.589 | 2.00 |

Figure 13:
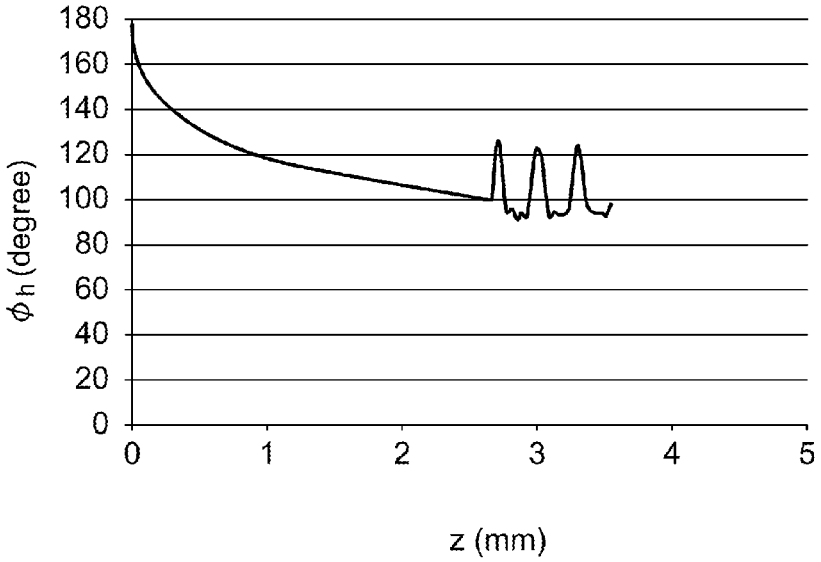
FIG. 13 shows a relationship between z of the light receiving surface and angle ϕh which a normal to the light receiving surface forms with the central axis AX in the optical element of Example 2.

FIG. 13 shows a relationship between z of the light receiving surface 101 and angle ϕh which a normal to the light receiving surface 101 forms with the central axis AX in the optical element of Example 2. The horizontal axis of FIG. 13 represents z while the vertical axis represents ϕh. According to FIG. 13, in the range where z is 2.689 mm or less, ϕh monotonously decreases as z increases. In the range where z is greater than 2.689 mm, ϕh repeatedly fluctuates as z increases. In other words, in the range where z is greater than 2.689 mm, ϕh which is a function of z has local maximum values and local minimum values.

Specifically, in FIG. 13, ϕh has 3 local maximum values and 3 local minimum values. Minor fluctuations of ϕh around the local minimum values have been ignored. Difference in ϕh between a local maximum value and a local minimum value which are adjacent to each other is approximately 30 degrees.

When distance from O2 in the direction of the central axis AX is represented as z, a shape of the exit surface 103 around the central axis AX is what does not cause total reflection of rays from the light source on the exit surface and can be represented by the following equation.

$$z = \frac{cr^2}{1+\sqrt{1-(1+k)c^2r^2}} + \sum_{i=1}^{N} A_i r^i \quad (2)$$

$$c = 1/R$$

In the equation, r represents distance from the central axis AX, c represents curvature, R represents radius of curvature, k represents conic constant and Ai represents aspheric coefficient.

Table 6 shows numerical values of constants in Equation (2) which represents the exit surface of Example 2.

TABLE 6

| | |
|---|---|
| R | −1.000 |
| K | −8.9797 |
| A1 | 0.000 |
| A2 | −5.28E−02 |
| A3 | −4.04E−04 |
| A4 | −6.21E−05 |
| A5 | 0.000 |
| A6 | 1.72E−06 |
| A7 | 0.000 |
| A8 | −3.63E−08 |
| A9 | 0.000 |
| A10 | −1.42E−10 |

Figure 14:
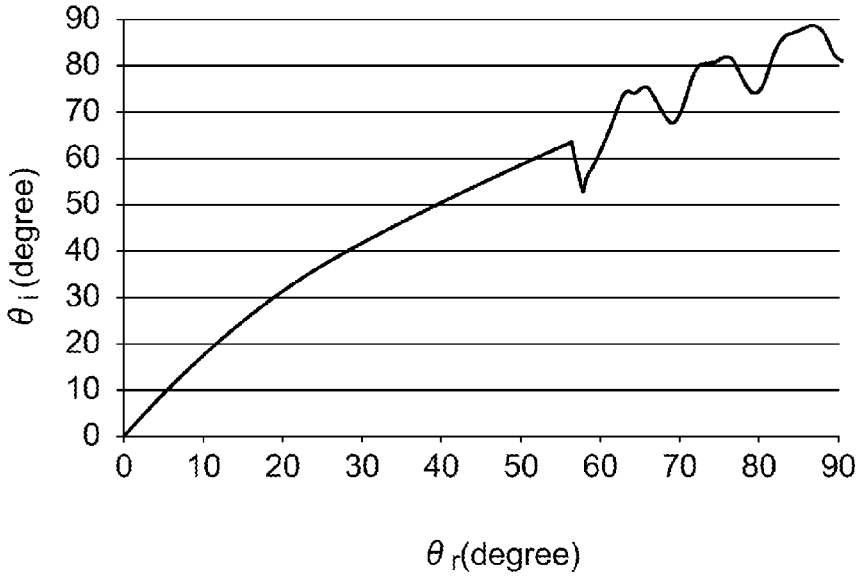
FIG. 14 shows a relationship between θr and θi in the optical element of Example.

FIG. 14 shows a relationship between θr and θi of the optical element of Example 2. The horizontal axis of FIG. 14 represents θr while the vertical axis represents θi. In the range where θr is approximately 55 degrees or less, θi monotonously increases as θr increases. In the range where θr is greater than approximately 55 degrees, θi increases while repeatedly fluctuating as θr increases. In other words, in the range where θr is greater than approximately 55 degrees, θi which is a function of θr has local maximum values and local minimum values.

Specifically, in FIG. 14, θi has 3 local maximum values and 3 local minimum values in the range where θr is from approximately 55 degrees to 90 degrees. Minor fluctuations of θi around the local maximum values have been ignored. Difference in θi between a local maximum value and a local minimum value which are adjacent to each other is approximately 15 degrees.

Figure 15:
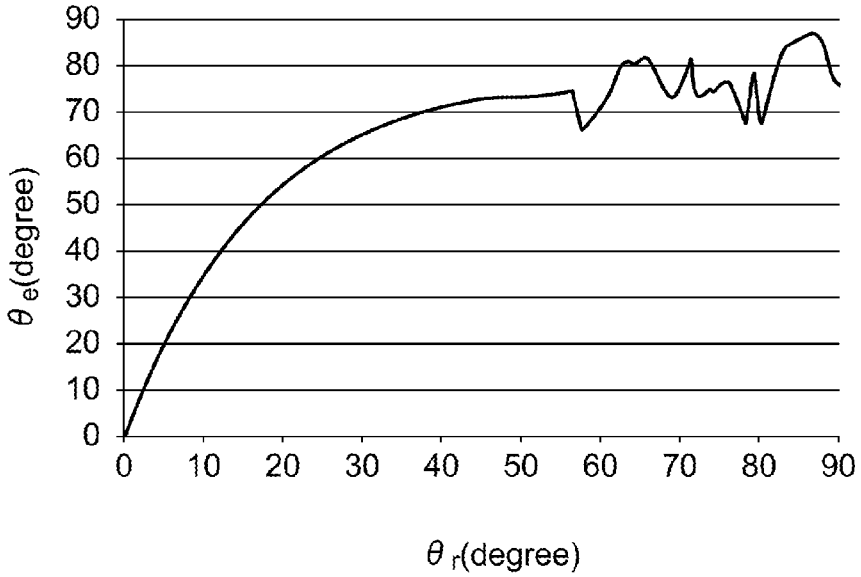
FIG. 15 shows a relationship between θr and θe in the optical element of Example 2.

FIG. 15 shows a relationship between θr and θe of the optical element of Example 2. The horizontal axis of FIG. 15 represents θr while the vertical axis represents θe. In the range where θr is approximately 55 degrees or less, θe monotonously increases as θr increases. In the range where θr is greater than approximately 55 degrees, θe increases while repeatedly fluctuating with a peak-to-peak amplitude of approximately 15 degrees as θr increases. In other words, θe which is a function of θr has local maximum values and local minimum values in the range where θr is greater than approximately 55 degrees.

Comparative Example 2

In the present comparative example, the distance T between P0 and O2 is given as below.

T=5.513 mm

The distance h between P0 and O1 is given as below.

h=3.569 mm

When distance from O1 in the direction of the central axis AX is represented as z, a shape of the light receiving surface can be represented by Equation (1). Further, values of constants in Equation (1) are those shown in Table 4. That is, a shape of the light receiving surface of Comparative Example 2 is identical with that of Example 2 in the range where z is 2.689 mm or less, and in the range where z is greater than 2.689 mm, ϕh which is a function of z does not have a local maximum value or a local minimum value and monotonously decreases as z increases. In other words, the light receiving surface of the optical element of Comparative Example 2 differs from the light receiving surface of Example 2 in that it does not have a diffusing area of the light receiving surface.

When distance from O2 in the direction of the central axis AX is represented as z, a shape of the exit surface around the central axis AX is what does not cause total reflection of rays from the light source on the exit surface and can be represented by Equation (2). Further, values of constants in Equation (2) are those shown in Table 6. That is, a shape of the exit surface of Comparative Example 2 is identical with that of Example 2.

Performance Comparison Between Example 2 and Comparative Example 2

Performance comparison between Example 2 and Comparative Example 2 will be made by comparing light intensity distribution between the case of a combination of the light source shown in FIGS. 1A and 1B and the optical element of Example 2 and the case of a combination of the light source shown in FIGS. 1A and 1B and the optical element of Comparative Example 2.

Figure 16:
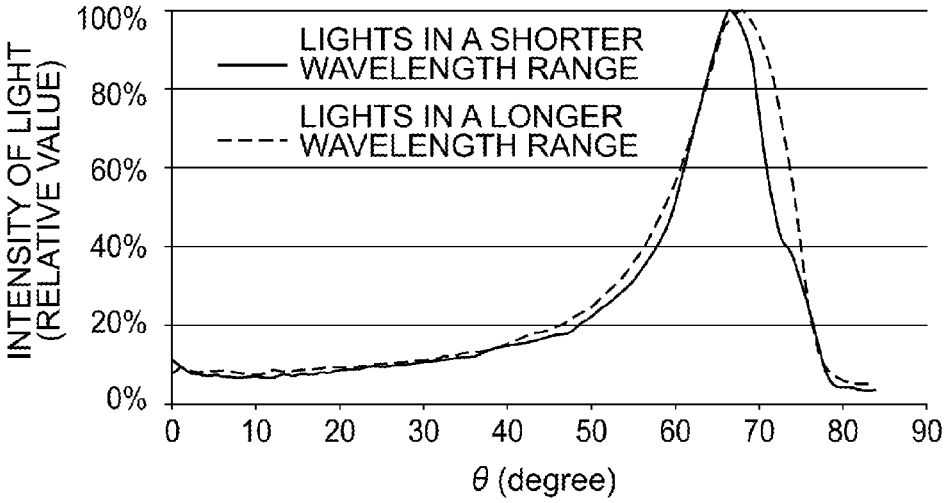
FIG. 16 shows a light intensity distribution for the case of a combination of the light source shown in FIGS. 1A and 1B and the optical element of Example 2.

FIG. 16 shows a light intensity distribution for the case of a combination of the light source shown in FIGS. 1A and 1B and the optical element of Example 2. The horizontal axis of FIG. 16 represents direction which forms angle θ with the central axis AX. The vertical axis of FIG. 16 represents relative value of intensity of light which is emitted in the direction which forms angle θ with the central axis AX. The solid line in FIG. 16 represents relative value of intensity of lights which have wavelengths of less than 500 nanometers (lights in a shorter wavelength range). The relative value of intensity is scaled such that the maximum value is 100%. The dashed line in FIG. 16 represents relative value of intensity of lights which have wavelengths of 500 nanometers or more (lights in a longer wavelength range). The relative value of intensity is scaled such that the maximum value is 100%.

Figure 17:
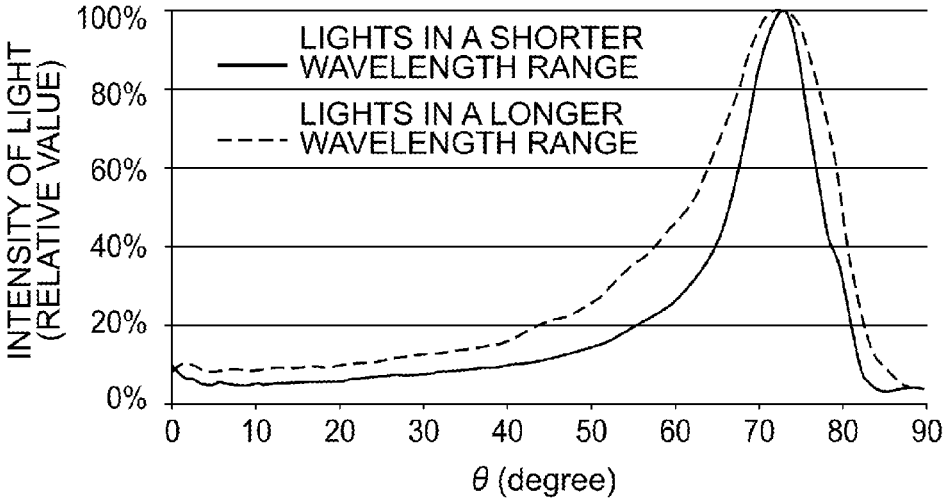
FIG. 17 shows a light intensity distribution for the case of a combination of the light source shown in FIGS. 1A and 1B and the optical element of Comparative Example 2.

FIG. 17 shows a light intensity distribution for the case of a combination of the light source shown in FIGS. 1A and 1B and the optical element of Comparative Example 2. The horizontal axis of FIG. 17 represents direction which forms angle θ with the central axis AX. The vertical axis of FIG. 17 represents relative value of intensity of light which is emitted in the direction which forms angle θ with the central axis AX. The solid line in FIG. 17 represents relative value of intensity of lights which have wavelengths of less than 500 nanometers (lights in a shorter wavelength range). The relative value of intensity is scaled such that the maximum value is 100%. The dashed line in FIG. 17 represents relative value of intensity of lights which have wavelengths of 500 nanometers or more (lights in a longer wavelength range). The relative value of intensity is scaled such that the maximum value is 100%.

When FIG. 16 and FIG. 17 are compared with each other, difference in intensity of light between the shorter wavelength range and the longer wavelength range is greater in FIG. 17 which relates to Comparative Example 2. The difference between the both is particularly great in an area where θ is around 60 degrees. When the difference between the both is great, a difference in color is generated. For example, in the case that intensity of the longer wavelength range becomes greater in an area where θ is around 60 degrees as shown in FIG. 17, light becomes reddish in the area where θ is around 60 degrees.

Thus, the optical element of Example 2 is superior to that of Comparative Example 2 in preventing a difference in color from being generated.

Example 3

In FIG. 2, the coordinates of the point of intersection of the light receiving surface 101 and the central axis AX are represented as O1 while the coordinates of the point of intersection of the exit surface 103 and the central axis AX are represented as O2.

In the present example, the distance T between P0 and O2 is given as below.

T=5.385 mm

The distance h between P0 and O1 is given as below.

h=3.829 mm

When distance from O1 in the direction of the central axis AX is represented as z, a shape of the light receiving surface 101 can be represented by the following equation in the range where z is between 0 and 1.322 mm inclusive (0≤z≤1.322 mm).

$$z = \frac{cr^2}{1+\sqrt{1-(1+k)c^2r^2}} + \sum_{i=1}^{N} A_i r^i \qquad (1)$$

$$c = 1/R$$

In the equation, r represents distance from the central axis AX, c represents curvature, R represents radius of curvature, k represents conic constant and Ai represents aspheric coefficient.

Table 7 shows numerical values of constants in Equation (1) which represents the light receiving surface 101 of Example 3.

TABLE 7

| | |
|---|---|
| R | −0.8668 |
| k | −0.7490 |
| A1 | 0.000 |
| A2 | 0.000 |
| A3 | 0.000 |
| A4 | 0.000 |

A shape of the area of the light receiving surface 101 which extends from z=1.322 mm to the face 105, that is, a shape of the diffusing area is represented by the following equation.

$$z = \frac{cr^2}{1+\sqrt{1-(1+k)c^2r^2}} + \sum_{i=1}^{N} A_i r^i + B\sin Kr \qquad (3)$$

$$c = 1/R$$

In the equation, r represents distance from the central axis AX, c represents curvature, R represents radius of curvature, k represents conic constant and Ai represents aspheric coefficient. Further, K is a constant. The unit of K is 1/mm.

Table 8 shows numerical values of constants in Equation (3) which represents the light receiving surface of Example 3.

TABLE 8

| | |
|---|---|
| R | −0.8668 |
| k | −0.7490 |
| A1 | 0.000 |
| A2 | 0.000 |
| A3 | 0.000 |
| A4 | 0.000 |
| B | 0.050 |
| K | 52.5 |

Figure 18:
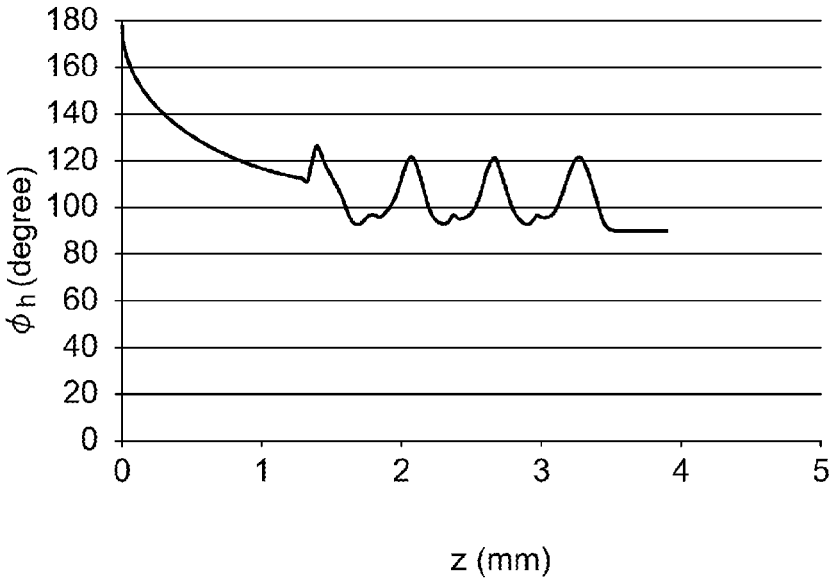
FIG. 18 shows a relationship between z and angle ϕh which a normal to the light receiving surface forms with the central axis AX in the optical element of Example 3.

FIG. 18 shows a relationship between z of the light receiving surface 101 and angle ϕh which a normal to the light receiving surface 101 forms with the central axis AX in the optical element of Example 3. The horizontal axis of FIG. 18 represents z while the vertical axis represents ϕh. According to FIG. 18, in the range where z is 1.322 mm or less, ϕh monotonously decreases as z increases. In the range where z is greater than 1.322 mm, ϕh repeatedly fluctuates as z increases. In other words, in the range where z is greater than 1.322 mm, ϕh which is a function of z has local maximum values and local minimum values.

Specifically, in FIG. 18, ϕh has 4 local maximum values and 3 local minimum values. Minor fluctuations of ϕh around the local minimum values have been ignored. Difference in ϕh between a local maximum value and a local minimum value which are adjacent to each other is approximately 30 degrees.

When distance from O2 in the direction of the central axis AX is represented as z, a shape of the exit surface 103 around the central axis AX is what does not cause total reflection of rays from the light source on the exit surface and can be represented by the following equation.

$$z = \frac{cr^2}{1+\sqrt{1-(1+k)c^2r^2}} + \sum_{i=1}^{N} A_i r^i \tag{2}$$

$$c = 1/R$$

In the equation, r represents distance from the central axis AX, c represents curvature, R represents radius of curvature, k represents conic constant and Ai represents aspheric coefficient.

Table 9 shows numerical values of constants in Equation (2) which represents the exit surface of Example 3.

TABLE 9

| | |
|---|---|
| R | −0.6625 |
| k | −8.5998 |
| A1 | 0.000 |
| A2 | −5.35E−02 |
| A3 | −5.32E−04 |
| A4 | −8.50E−04 |
| A5 | 0.000 |
| A6 | 3.31E−06 |
| A7 | 0.000 |
| A8 | −3.94E−08 |
| A9 | 0.000 |
| A10 | −3.22E−10 |

Figure 19:
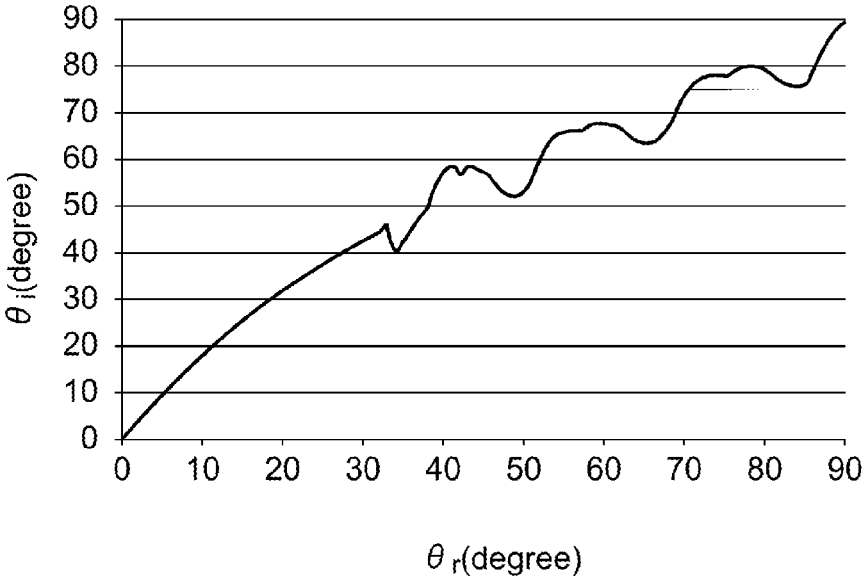
FIG. 19 shows a relationship between θr and θi in the optical element of Example 3.

FIG. 19 shows a relationship between θr and θi of the optical element of Example 3. The horizontal axis of FIG. 19 represents θr while the vertical axis represents θi. In the range where θr is approximately 32 degrees or less, θi monotonously increases as θr increases. In the range where θr is greater than approximately 32 degrees, θi increases while repeatedly fluctuating as θr increases. In other words, in the range where θr is greater than approximately 32 degrees, θi which is a function of θr has local maximum values and local minimum values.

Specifically, in FIG. 19, θi has 3 local maximum values and 4 local minimum values in the range where θr is from approximately 32 degrees to 90 degrees. Minor fluctuations of θi around the local maximum values have been ignored. Difference in θi between a local maximum value and a local minimum value which are adjacent to each other ranges from 15 degrees to 20 degrees.

Figure 20:
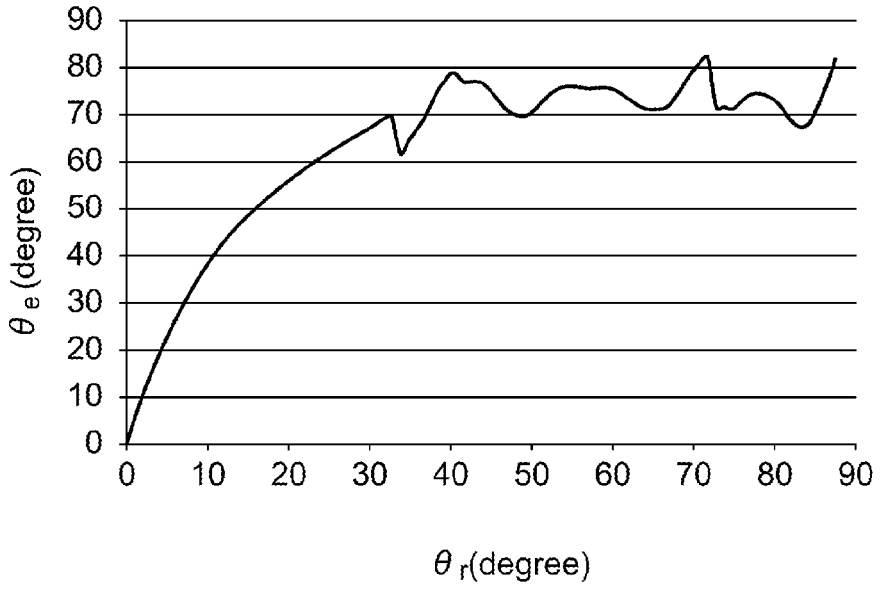
FIG. 20 shows a relationship between θr and θe in the optical element of Example 3.

FIG. 20 shows a relationship between θr and θe of the optical element of Example 3. The horizontal axis of FIG. 20 represents θr while the vertical axis represents θe. In the range where θr is approximately 32 degrees or less, θe monotonously increases as θr increases. In the range where θr is greater than approximately 32 degrees, θe increases while repeatedly fluctuating with a peak-to-peak amplitude of approximately 15 degrees as θr increases. In other words, in the range where θr is greater than approximately 32 degrees, θe which is a function of θr has local maximum values and local minimum values.

Comparative Example 3

In the present comparative example, the distance T between P0 and O2 is given as below.

T=5.385 mm

The distance h between P0 and O1 is given as below.

h=3.829 mm

When distance from O1 in the direction of the central axis AX is represented as z, a shape of the light receiving surface can be represented by Equation (1). Further, values of constants in Equation (1) are those shown in Table 7. That is, a shape of the light receiving surface of Comparative Example 2 is identical with that of Example 3 in the range where z is 1.322 mm or less, and in the range where z is greater than 1.322 mm, ϕh which is a function of z does not have a local maximum value or a local minimum value and monotonously decreases as z increases. In other words, the light receiving surface of the optical element of Comparative Example 3 differs from the light receiving surface of Example 3 in that it does not have a diffusing area of the light receiving surface.

When distance from O2 in the direction of the central axis AX is represented as z, a shape of the exit surface around the central axis AX is what does not cause total reflection of rays from the light source on the exit surface and can be represented by Equation (2). Further, values of constants in Equation (2) are those shown in Table 9. That is, a shape of the exit surface of Comparative Example 3 is identical with that of Example 3.

Performance Comparison Between Example 3 and Comparative Example 3

Performance comparison between Example 3 and Comparative Example 3 will be made by comparing light intensity distribution between the case of a combination of the light source shown in FIGS. 1A and 1B and the optical element of Example 3 and the case of a combination of the light source shown in FIGS. 1A and 1B and the optical element of Comparative Example 3.

Figure 21:
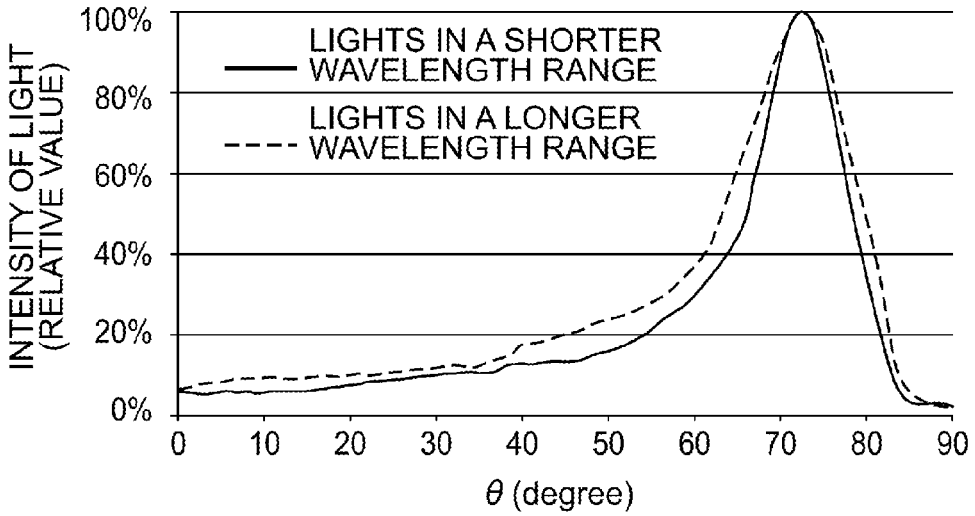
FIG. 21 shows a light intensity distribution for the case of a combination of the light source shown in FIGS. 1A and 1B and the optical element of Example 3.

FIG. 21 shows a light intensity distribution for the case of a combination of the light source shown in FIGS. 1A and 1B and the optical element of Example 3. The horizontal axis of FIG. 21 represents direction which forms angle θ with the central axis AX. The vertical axis of FIG. 21 represents relative value of intensity of light which is emitted in the direction which forms angle θ with the central axis AX. The solid line in FIG. 21 represents relative value of intensity of lights which have wavelengths of less than 500 nanometers (lights in a shorter wavelength range). The relative value of intensity is scaled such that the maximum value is 100%. The dashed line in FIG. 21 represents relative value of intensity of lights which have wavelengths of 500 nanometers or more (lights in a longer wavelength range). The relative value of intensity is scaled such that the maximum value is 100%.

Figure 22:
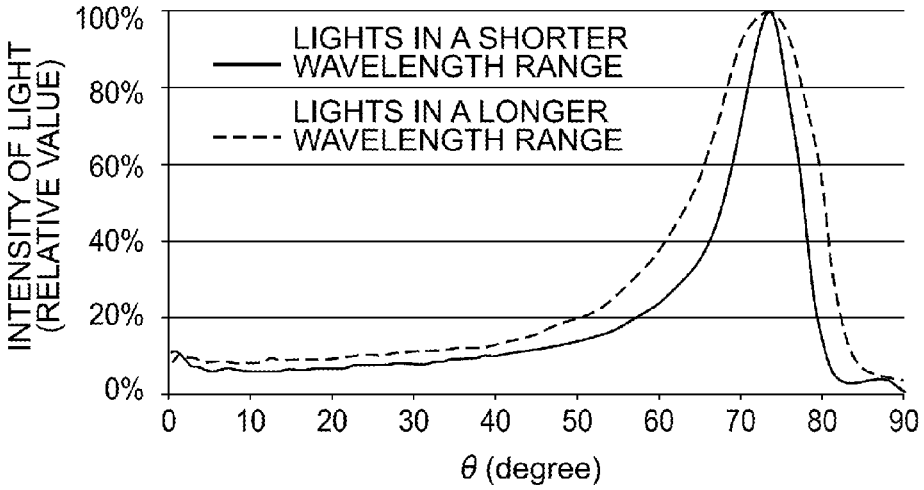
FIG. 22 shows a light intensity distribution for the case of a combination of the light source shown in FIGS. 1A and 1B and the optical element of Comparative Example 3.

FIG. 22 shows a light intensity distribution for the case of a combination of the light source shown in FIGS. 1A and 1B and the optical element of Comparative Example 3. The horizontal axis of FIG. 22 represents direction which forms angle θ with the central axis AX. The vertical axis of FIG. 22 represents relative value of intensity of light which is emitted in the direction which forms angle θ with the central axis AX. The solid line in FIG. 22 represents relative value of intensity of lights which have wavelengths of less than 500 nanometers (lights in a shorter wavelength range). The relative value of intensity is scaled such that the maximum value is 100%. The dashed line in FIG. 22 represents relative value of intensity of lights which have wavelengths of 500 nanometers or more (lights in a longer wavelength range). The relative value of intensity is scaled such that the maximum value is 100%.

When FIG. 21 and FIG. 22 are compared with each other, difference in intensity of light between the shorter wavelength range and the longer wavelength range is greater in FIG. 22 which relates to Comparative Example 3. The difference between the both is particularly great in an area where θ is around 65 degrees. When the difference between the both is great, a difference in color is generated. For example, in the case that intensity of the longer wavelength range becomes greater in an area where θ is around 65 degrees as shown in FIG. 22, light becomes reddish in the area where θ is around 65 degrees.

Thus, the optical element of Example 3 is superior to that of Comparative Example 3 in preventing a difference in color from being generated.

Other Preferred Embodiments

Optical elements according to the present invention are preferably manufactured by injection molding in which molds are used. In the process, the position of a resin gate through which resin (plastic) is injected to the mold will affect the product.

Figure 23A:
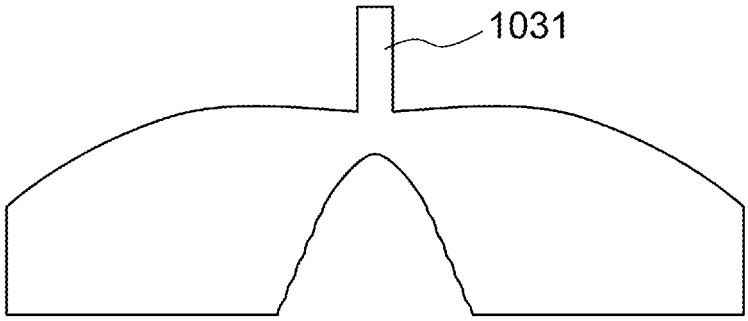
FIGS. 23A and 23B show the case in which a resin gate is arranged around the center of the exit surface of an optical element.
Figure 23B:
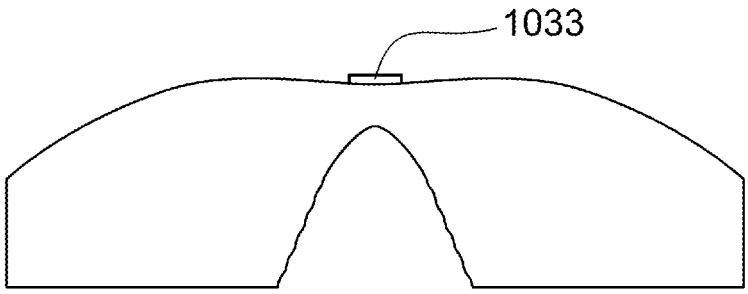

FIGS. 23A and 23B show the case in which a resin gate 1031 is arranged around the center of the exit surface 103 of an optical element. FIG. 23A shows the state in which the resin gate 1031 is arranged. FIG. 23B shows a shape of the optical element which has been manufactured using the resin gate 1031 arranged as shown in FIG. 23A. A resin gate mark 1033 has a scattering surface, which diffuses high-intensity lights around the center. Further, it is preferable particularly when a plane to be illuminated is located nearby, that the scattering surface helps high-intensity rays around the center of the light source diffuse.

Figure 24A:
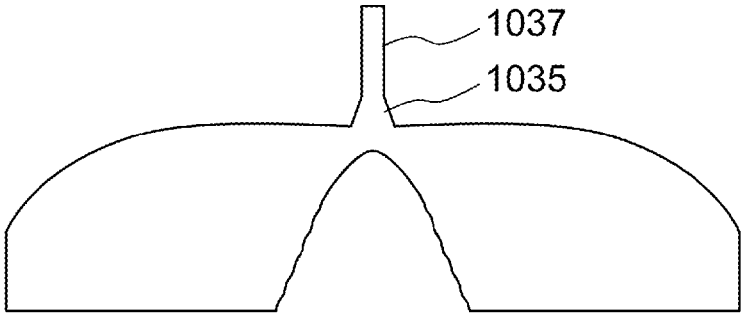
FIGS. 24A and 24B show the case in which a portion in the form of a truncated cone is provided around the center of the exit surface of an optical element, and a resin gate is arranged on the portion.
Figure 24B:
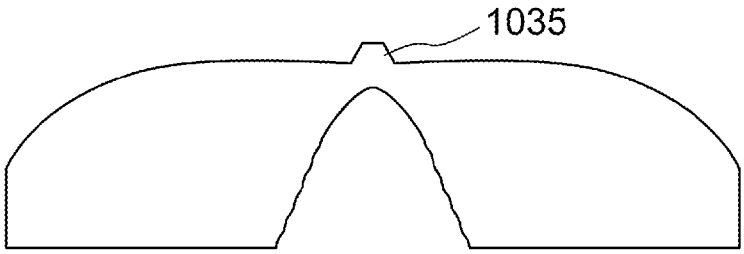

FIGS. 24A and 24B show the case in which a portion 1035 in the form of a truncated cone is provided around the center of the exit surface 103 of an optical element, and a resin gate 1037 is arranged on the portion. FIG. 24A shows the state in which the resin gate 1037 is arranged. FIG. 24B shows a shape of the optical element which has been manufactured using the resin gate 1037 arranged as shown in FIG. 24A. The portion 1035 in the form of a truncated cone diffuses high-intensity lights around the center, and a resin gate mark has a scattering surface, which diffuses high-intensity lights around the center. Further, it is preferable particularly when a plane to be illuminated is located nearby, that the scattering surface helps high-intensity rays around the center of the light source diffuse.

Figure 25:
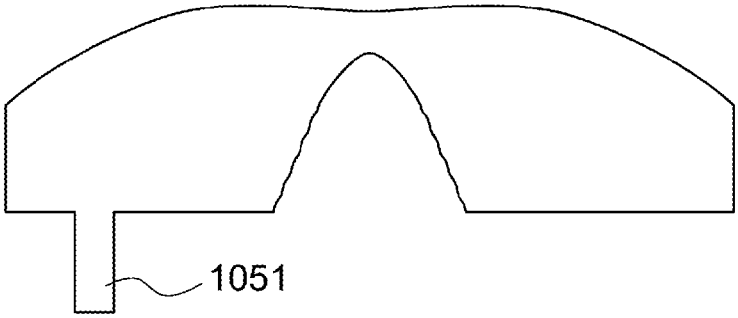
FIG. 25 shows the case in which a single resin gate is arranged on the bottom face 105 of an optical element.

FIG. 25 shows the case in which a single resin gate 1051 is arranged on the bottom face 105 of an optical element. In this embodiment, a resin gate mark does not affect the optical surfaces.

Figure 26:
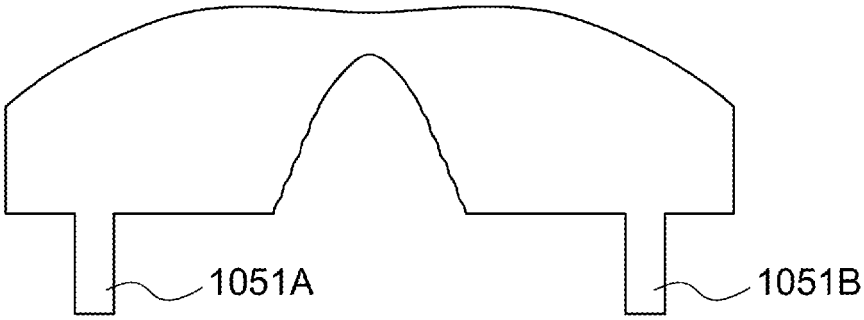
FIG. 26 shows the case in which two resin gates and are arranged on the bottom face of an optical element.

FIG. 26 shows the case in which two resin gates 1051A and 1051B are arranged on the bottom face 105 of an optical element. In this embodiment, resin gate marks do not affect the optical surfaces.

It is preferable that a portion of the exit surface or the bottom face of an optical element is provided with a diffusing structure or a diffusing material. The diffusing structure can be microscopic depressions or projections in a spherical or an aspherical shape on a surface, each of the depressions or each of the projections being included in a circle of diameter of less than 1 mm on the surface. Alternatively, the diffusing structure can be microscopic depressions or projections in a conical, a triangular pyramid, a quadrangular pyramid shape on a surface, each of the depressions or each of the projections being included in a circle of diameter of less than 1 mm on the surface. Alternatively, the diffusing structure can be a grained surface by roughening, a refracting structure including microscopic curved surfaces or prisms such as a microlens array, or a total-reflecting structure including prisms. The diffusing material can be scattering materials such as acrylic powder, polystyrene particles, silicon powder, silver powder, titanium oxide powder, aluminium powder, white carbon, magnesia oxide and zinc oxide.

Figure 27:
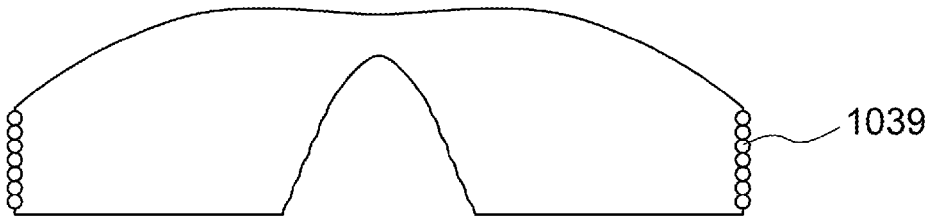
FIG. 27 shows a construction of an optical element which is provided with a diffusing structure or a diffusing material on the periphery of the exit surface.

FIG. 27 shows a construction of an optical element which is provided with a diffusing structure or a diffusing material 1039 on the periphery of the exit surface. Portions marked with circles in FIG. 27 represent the diffusing structure or the diffusing material. According to the optical element of the present embodiment, lights emitted from the periphery of the exit surface are further diffused.

Figure 28:
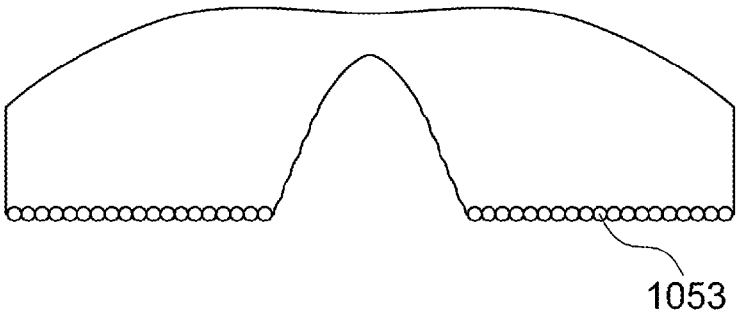
FIG. 28 shows a construction of an optical element which is provided with a diffusing structure or a diffusing material on the bottom face.

FIG. 28 shows a construction of an optical element which is provided with a diffusing structure or a diffusing material 1053 on the bottom face. According to the optical element of the present embodiment, rays which reach a plane to be illuminated via the bottom face of the optical element can be prevented from generating brightness irregularities on the plane to be illuminated. The rays which reach the plane to be illuminated via the bottom face of the optical element may include rays which have undergone total reflection inside the optical element, rays which have been reflected on the plane to be illuminated, and rays from adjacent optical elements.

Further, as the structure of the diffusing area of the light receiving surface, the above-described diffusing structure or diffusing material may be provided in place of the above-described shape of the optical surface.

Shapes of the light receiving surface and the exit surface of an optical element are not limited to those which are rotationally symmetric around the axis AX. For example, a space around the axis AX may be partitioned based on angle around the optical axis into plural zones and different shapes may be provided in respective zones. The zones may or may not be those with the same angle, such as four zones with 90 degrees or six zones with 60 degrees.

Further, in some of the zones alone, a diffusing area may be provided on the light receiving surface.

According to the above-described embodiments, different light distributions can be realized for respective directions corresponding to zones around the axis AX. For example, particularly in a specific direction around the axis AX, color difference can be reduced.

What is claimed is:

1. An optical element, comprising:

a light receiving surface which is configured to cover a light source disposed on a plane, and an exit surface which covers the light receiving surface, the optical element being configured such that light from the light source passes through the light receiving surface and the exit surface and goes to the outside for illumination, wherein when an axis which passes through the center of the light source and which is perpendicular to the plane is designated as an optical axis and the point of intersection of the optical axis and the light receiving surface is designated as O1, the light receiving surface is concaved around the optical axis with respect to the periphery, and wherein in a cross section of the optical element, the cross section containing the optical axis and being perpendicular to the plane, when an angle which a normal to the light receiving surface on a point P on the light receiving surface forms with the optical axis is designated as $\phi h$ and distance in the optical axis direction from the point O1 to the point P is designated as z, the light receiving surface is configured such that $\phi h$ has at least one local maximum value and at least one local minimum value with respect to z while the point P is moved along the light receiving surface from the point O1 to the plane.

2. An optical element according to claim 1, wherein the light receiving surface is shaped rotationally symmetric around the optical axis.

3. An optical element according to claim 1, wherein a space around the optical axis is partitioned based on angle around the optical axis into plural zones and the light receiving surface is configured to have different shapes in respective zones.

4. An optical element according to claim 3, wherein in some of the zones alone, the light receiving surface is configured such that $\phi h$ has at least one local maximum value and at least one local minimum value with respect to z while the point P is moved along the light receiving surface the from the point O1 to the plane.

5. An optical element according to claim 1, wherein when the point of intersection of the optical axis and the plane is designated as a point P0 and an angle which a line connecting the point P0 and the point P on the light receiving surface forms with the optical axis is designated as $\theta r$, the light receiving surface is configured such that $\phi h$ has at least one local maximum value and at least one local minimum value with respect to z in the range $30° < \theta r < 90°$.

6. An optical element according to claim 1, wherein a local maximum value and a local minimum value are adjacent to each other and between which a difference in $\phi h$ is 10 degrees or more.

7. An optical element according to claim 6, wherein a local maximum value and a local minimum value are adjacent to each other and between which a difference in $\phi h$ is 20 degrees or more.

8. An optical element, comprising:

a light receiving surface which is configured to cover a light source disposed on a plane, and an exit surface which covers the light receiving surface, the optical element being configured such that light from the light source passes through the light receiving surface and the exit surface and goes to the outside for illumination, wherein when an axis which passes through the center of the light source and which is perpendicular to the plane is designated as an optical axis, the point of intersection of the optical axis and the light receiving surface is designated as O1, and the point of intersection of the optical axis and the plane is designated as P0, the light receiving surface is concaved around the optical axis with respect to the periphery, and wherein in a cross section of the optical element, the cross section containing the optical axis and being perpendicular to the plane, when an angle which a line connecting the point P0 and a point P on the light receiving surface forms with the optical axis is designated as $\theta r$, and a direction of light which travels inside the optical element after having traveled from the point P0 to the point P forms with the optical axis is designated as $\theta i$, the light receiving surface is configured such that $\theta i$ has at least one local maximum value and at least one local minimum value with respect to $\theta r$ while the point P is moved along the light receiving surface from the point O1 to the plane.

9. An optical element according to claim 8, wherein the light receiving surface is shaped rotationally symmetric around the optical axis.

10. An optical element according to claim 8, wherein a space around the optical axis is partitioned based on angle around the optical axis into plural zones and the light receiving surface is configured to have different shapes in respective zones.

11. An optical element according to claim 10, wherein in some of the zones alone, the light receiving surface is configured such that $\theta i$ has at least one local maximum value and at least one local minimum value with respect to $\theta r$ while the point P is moved along the light receiving surface the from the point O1 to the plane.

12. An optical element according to claim 8, wherein the light receiving surface is configured such that $\theta i$ has at least one local maximum value and at least one local minimum value with respect to $\theta r$ in the range $30° < \theta r < 90°$.

13. An optical element according to claim 8, wherein a local maximum value and a local minimum value are adjacent to each other and between which a difference in $\theta i$ is 5 degrees or more.

14. An optical element according to claim 13, wherein a local maximum value and a local minimum value are adjacent to each other and between which a difference in $\theta i$ is 10 degrees or more.

15. An illumination unit comprising a light source and the optical element according to claim 1.

* * * * *